United States Patent [19]

Bill

[11] 4,109,440

[45] Aug. 29, 1978

[54] STRUCTURAL SECTION

[76] Inventor: David Hewitt Bill, 65 Laburnam Street, Blackburn, Victoria, Australia, 3130

[21] Appl. No.: 729,789

[22] Filed: Oct. 5, 1976

[51] Int. Cl.[2] ..... E04C 3/30

[52] U.S. Cl. ..... 52/721; 52/731

[58] Field of Search ..... 52/731, 730, 729, 634, 52/636, 720, 721, 726; 403/188, 231

[56] References Cited

U.S. PATENT DOCUMENTS

| | | | |
|---|---|---|---|
| 2,970,676 | 2/1961 | Maciunas | 52/732 |
| 3,374,593 | 3/1968 | Rensch | 52/731 |
| 3,396,989 | 8/1968 | Kolbe | 52/731 |
| 3,788,024 | 1/1974 | De Hartog | 52/726 |
| 3,989,396 | 11/1976 | Matsumoto | 52/731 |

FOREIGN PATENT DOCUMENTS

| | | | |
|---|---|---|---|
| 1,509,054 | 12/1968 | Fed. Rep. of Germany | 52/720 |

*Primary Examiner*—John E. Murtagh

*Attorney, Agent, or Firm*—Larson, Taylor and Hinds

[57] ABSTRACT

This specification discloses an improved structural section for use as a beam or rafter and comprising two similarly profiled metal sections joined together so that their profiles define a central box-section and a plurality of spaced stiffener members located within the box-section to render the box-section substantially rigid. The box-section may be of any preferred shape. For example, two metal sections with V-shaped profiles may define a central square box-section or two metal sections with trapezoidal shaped profiles may define a generally hexagonal box-section. The specification also discloses the use of a connector plate for transferring horizontal loads applied to the section to the box-section and comprising a cut-out on one side of the plate having a shape corresponding to the profile in one of the metal sections. The plate is shaped to engage the top of the section to positively locate the plate in position. The section is adapted for use with a column having a spigot shaped correspondingly to the box-section for insertion therein.

12 Claims, 5 Drawing Figures

1
2
4
5
6
6'
7
8
9
10
11
12
13
C
H
S

STRUCTURAL SECTION

This invention relates to an improved structural section for use as a beam or rafter in cantilever type structural steelworks employed in the construction of buildings.

It is the present practice, in the construction of cantilever type structural steelwork, to use 'C' or 'Z' steel sections as rafters, girt beams and purlins. For such applications, C and Z sections have a substantial limitation in that their horizontal load bearing properties are unequal from one direction to the other.

It is the main object of this invention to provide an improved structural section in which this problem is avoided.

The invention provides a structural section comprising two similarly profiled metal sections joined together such that their profiles define a central box section, and a plurality of spaced stiffener members located within the box section to render the box section substantially rigid.

In one preferred form, the stiffener members comprise metal plates having the same configuration as the internal shape of the box section and arranged with their edges in engagement with the box section.

Preferably the plates have lugs formed on at least two opposite edges, said lugs co-operating with slots in the box section to locate the plates along the length of the section.

Each metal section is preferably formed with a V-section profile therein and the sections may be initially of channel section to provide flanges on the finished structural section.

Horizontal loadings are preferably applied to the structural section via a specially formed connection plate which has a cut-out corresponding in shape to the profile defining one half of the box section.

The cut-out may be formed with lugs adapted to co-operate with slots in the box section whereby the connection plate may be located in position. Preferably, the plate is also formed with a portion adapted to engage the top flanges of the section.

One presently preferred form of the invention is shown in the accompanying drawings in which.

Figures 1, 2, 3:
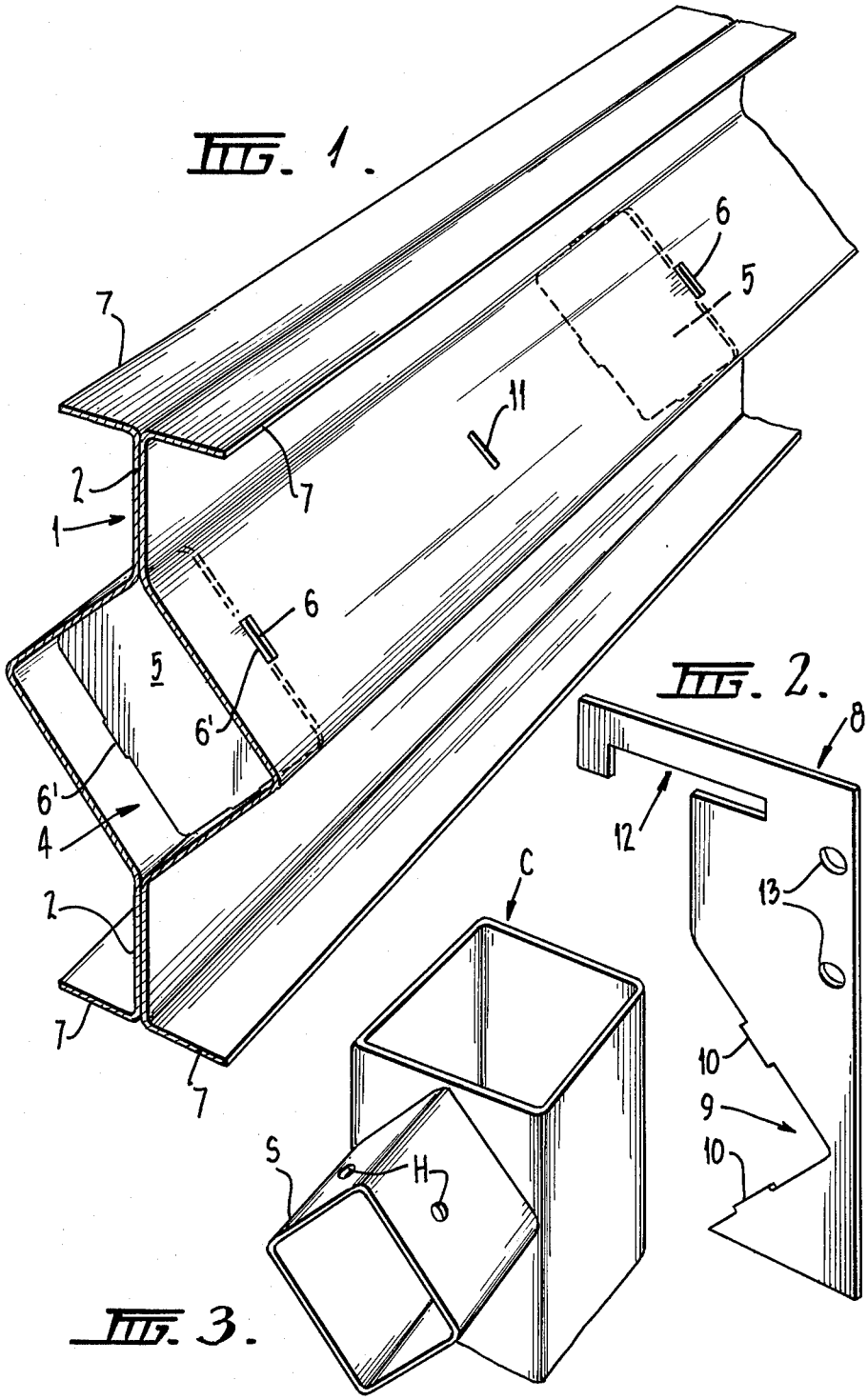
FIG. 1 is a perspective view of part of a structural section embodying the invention.
FIG. 2 is a perspective view of a connection plate adapted for use within the section of FIG. 1.
FIG. 3 is a perspective view of the top end of a column adapted for use within the section of FIG. 1.
Figure 4:
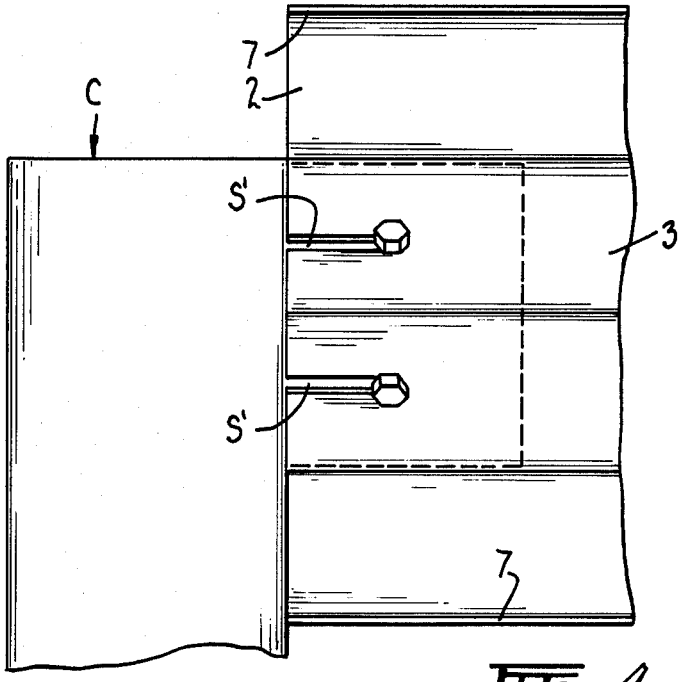
FIG. 4 is a side elevation showing the section fitted to the column.

As will be clear from FIG. 1, the improved structural section 1 comprises two similar sheet metal channel sections 2 which have been roll formed with a central V-shaped profile 3 in their webs and joined together, say by spot welding, back to back with the V-profiles directed away from each other so that the section 1 has a central box-section 4 therein. Within the box-section 4 there are located a plurality of spaced stiffener plates 5 having the same shape as the box-section profile and formed with lugs 6 in their edges that co-operate with slots 6' in the box-section 4. The edges of the stiffener plates 5 thereby engage the inside surfaces of the box-section 4 to prevent deformation of the section under load.

The section 1 shown clearly has the same horizontal load bearing capacity from either side and for a similar gauge material has a comparable load bearing capacity to a corresponding C or Z section. The section 1 also has far superior torsional stiffness than corresponding gauge C and Z sections, the torsional load being transferred from stiffener 5 to stiffener 5 along the length of the section.

The load bearing capacity of the section 1 may be increased for a given gauge of metal by increasing the number of stiffeners 5 in a given length of section 1 and/or by increasing the gauge of the metal from which the stiffeners are made.

To manufacture the section 1, sheet metal is formed into a channel section 2 and then formed with the V-shaped profile 3 having dimensions dictated by the load bearing requirements of the section 1 under manufacture. The resulting V-shaped profile 3 is then formed with slots 6' at predetermined intervals once again determined by the load bearing requirements. The required number of stiffeners 5 are then set in one profiled channel 2 with the lugs 6 on two edges in the slots 6' and a similarly profiled channel 2 laid on top thereof so that the two remaining lugs 6 on each stiffener 5 are located in the slots 6' in the top channel 2. The two channels 2 are then spot welded together at spaced intervals along their webs to form the improved section 1.

A structural section formed in accordance with the above description from mild steel sheet metal 1mm thick with each flange 30mm wide, each vertical web portion 50mm deep and each V-shaped profile with 70mm sides has the following structural properties: cross-sectional area 600mm$^2$, moment of inertia in the $x$—$x$ direction $3.28 \times 10^6$mm$^4$, moment of inertia in the $y$—$y$ direction $0.158 \times 10^6$mm$^4$, and radius of gyration in the $y$—$y$ direction 16.22 mm. Stiffener plates of 1mm gauge material are located at either end of the section and at spacings of from 600–900mm. However, it has been determined that the stiffeners are only essential at either end and at positions of application of concentrated loads. The structural properties of the section in bending are comparable with those of standard C or Z sections of similar cross-sectional areas and the improved section has the advantage of symmetrical horizontal load bearing properties.

The preferred form shown in the drawings is provided with relatively wide flanges 7 although such flanges may be made wider or narrower as required. However, for most sheet metal gauges the webs of the section 1 have insufficient strength to support the required loads imposed on roof purlins or floor joists. In such situations, a connection plate 8 shown in FIG. 2 is used to transfer the horizontal loads applied by such members to the box-section 4 of the section 1.

The connection plate 8 has a V-shaped cut-out 9 corresponding to the shape of the V-profile 3 but the cut-out is formed with lugs 10 adapted to locate in slots 11 formed in one or the other V-profile 3. The plate 8 is also formed with a cut-out 12 which in use engages the flanges 7 at the top of the section 1 to locate the plate 8 in position. If desired however, the plate 8 could be welded to the section 1. The plate 8 has bolt holes 13 for connection or purlins or floor joists thereto. In the case of a sloping roof, a series of plates 8 of different sizes having the bolt holes 13 at varying heights above the V-cut-out 9 would be provided.

In order to secure the improved section to standard steel column C, the column has a spigot S having the same shape as the box-section 4 welded thereto as shown in FIG. 3. The spigot S may be formed with a hole H and a nut (not shown) welded inside to take a fastening bolt B passing through slotted holes S' in the V-profile 3 of Section 1, when the spigot has been inserted in the box-section 4.

It will be appreciated from the above that once the beam-rafter section, plate 8 and columns with spigots have been fabricated in a factory, the on site man hours are substantially reduced compared with previous systems involving the use of C and Z sections. Also the design of the structural steelwork in the structure is simplified because of the equal load bearing capacity of the beam-rafter section from either side.

Figure 5:
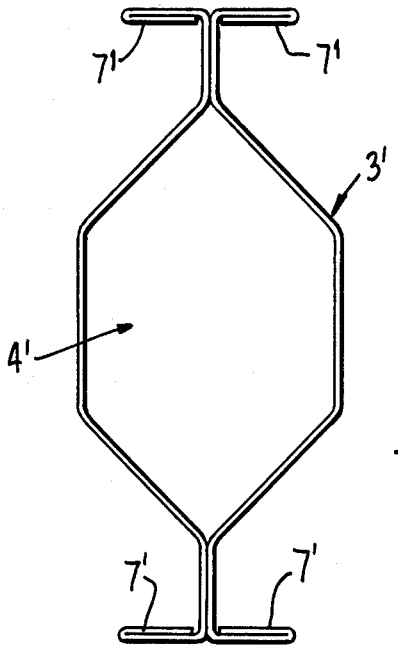
FIG. 5 is an end view of a modified section embodying the invention.

The profile of the box-section may be modified as desired to produce different structural properties. One such modification is shown in FIG. 5 of the drawings. In this modification, the flange 7' is of double thickness and the profile 3' forming the box-section 4' is of trapezoidal form. Otherwise the section is formed as in the first embodiment and co-operates similarly with suitably modified connector plates and spigots. A section formed from 1 mm mild steel with 30mm flanges and webs and with 60mm sides in the profile 3' has a 720mm$^2$ cross-sectional area, a moment of inertia about $x$—$x$ of $4.48 \times 10^6$mm$^4$, a moment of inertia about $y$—$y$ of $0.175 \times 10^6$mm$^4$ and a radius of gyration about $y$—$y$ of 15.5 mm.

I claim:

1. The combination of a structural section and a connector plate, said structural section comprising two similarly profiled metal sections joined together to define a central box-section, and a plurality of spaced stiffener members located within the box-section to render the box-section substantially rigid, said structural section including two substantially flat mating portions located adjacent to said box-section and said connector plate being formed to engage the surface of one of the mating portions of the structural section as well as said box-section thereof so that loads applied to said structural section through said connector plate are transferred from said one mating portion to said box-section.

2. The combination of claim 1, wherein said stiffener members comprise metal plates having the same configuration as the internal shape of the box-section and arranged with their edges in engagement with the box-section.

3. The combination of claim 2, wherein said plates have lugs formed on at least two opposite edges, said lugs co-operating with slots in the box-section to locate the plates along the length of the section.

4. The combination of claim 1, wherein said metal sections are formed with a central V-shaped profile to define a square box-section therebetween.

5. The combination of claim 4, wherein said metal sections are channel sections and are connected back to back so that the resulting structural section is flanged.

6. The combination of claim 1, wherein said metal sections are formed with a trapezoidal shaped profile to define a generally hexagonal box-section therebetween.

7. The combination of claim 1 wherein said plate is formed with a cut-out in one side thereof and having a shape corresponding to the profile of one said metal section.

8. The combination of claim 7, wherein said cut-out is formed with lugs adapted to engage holes in one of the metal sections whereby the plate is located in position on the section.

9. The combination of claim 1, wherein each said structural section includes flanges at the edges thereof and said plate is shaped to engage the top flanges of the section to positively locate the plate in position on the section.

10. The combination of claim 1 in combination with columns having spigots thereon adapted to engage within the box-section support the section in an elevated position.

11. The combination of claim 9, further comprises slots formed in the ends of the box-section through which connector members are passed to engage the spigots on the columns.

12. The combination of claim 1 wherein said structural sections each include intermediate, substantially flat mating portions which are located on opposite sides of said box-section and which mate with the corresponding mating portions of the other structural section, and flange portions located at the outboard ends thereof.

* * * * *